United States Patent [19]

De Pierre et al.

[11] 4,131,461

[45] Dec. 26, 1978

[54] METHOD AND APPARATUS FOR USE IN THE EXTRUSION OF BILLETS

[75] Inventors: Vincent De Pierre; Ferdinand J. Gurney, both of Dayton, Ohio

[73] Assignee: The United States of America as represented by the Secretary of the Air Force, Washington, D.C.

[21] Appl. No.: 808,490

[22] Filed: Jun. 21, 1977

[51] Int. Cl.[2] ..... B22F 3/02; B22F 3/20

[52] U.S. Cl. ..... 75/208 CS; 75/208 R; 75/214; 29/420; 29/420.5; 29/424; 72/258; 72/272; 428/558

[58] Field of Search ..... 29/420, 424, 420.5; 75/208 R, 208 CS, 214; 72/272, 258; 428/558

[56] References Cited

U.S. PATENT DOCUMENTS 3,602,977 9/1971 Huet et al. ..... 29/420

OTHER PUBLICATIONS

Avitzur, *Metal Forming: Processes & Analysis,* (1968), pp. 188–193.

*Primary Examiner*—Brooks H. Hunt

*Attorney, Agent, or Firm*—Joseph E. Rusz; Richard J. Killoren

[57] ABSTRACT

A method and apparatus for use in the extrusion of billets having a powder filled container with the nose cap having a shaped projection extending into the container and the tail cap having a concave portion substantially corresponding to the shape of the nose cap. A filler tube for the container is provided in the tail cap.

3 Claims, 10 Drawing Figures

METHOD AND APPARATUS FOR USE IN THE EXTRUSION OF BILLETS

RIGHTS OF THE GOVERNMENT

The invention described herein may be manufactured and used by or for the Government of the United States for all governmental purposes without the payment of any royalty.

BACKGROUND OF THE INVENTION

This invention relates to a method and apparatus for use in the extrusion of power filled containers.

In the normal extrusion of billets, such as powder filled containers, tail pipe effects and parabolic noses occur in the extruded products. In these systems, the nose portion and tail portion of the extruded product are discarded. In billets, where the material used is a high cost item, it is desirable to provide a system which will provide a greater yield from the extruded product.

BRIEF SUMMARY OF THE INVENTION

According to this invention, the nose cap and tail cap of the extrusion container are shaped to substantially eliminate the normal tail pipe effect and parabolic nose on an extruded metal powder product. Also, with the nose cap and tail cap so shaped, the fill tube, located in the tail cap, provides a more uniform filling of the container with powder.

IN THE DRAWINGS

FIG. 3 is a schematic view of the billet of FIG. 2 after extrusion.

DETAILED DESCRIPTION OF THE INVENTION

Figure 1:
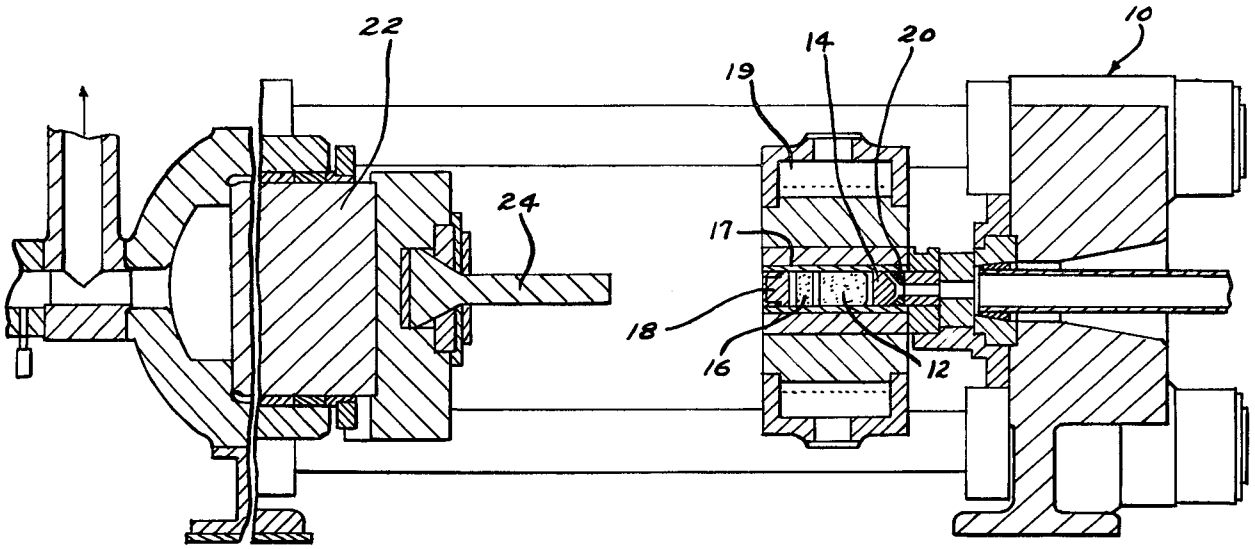
FIG. 1 shows an apparatus used in the forward extrusion of billets.

Reference is now made to FIG. 1 of the drawing which shows a conventional forward extrusion system 10 with a conventional load cell billet 12 for the extrusion of powdered materials, such as titanium alloys. A conventional nose block 14 is positioned ahead of billet 12 with a graphite follower block 16 and dummy block 18 being positioned behind billet 12. The billet is heated in a separate furnace, transferred to container liner 17 which is heated by heating element 19 and forced through the die 20 by means of a conventional ram 22 and stem 24.

Figure 2:
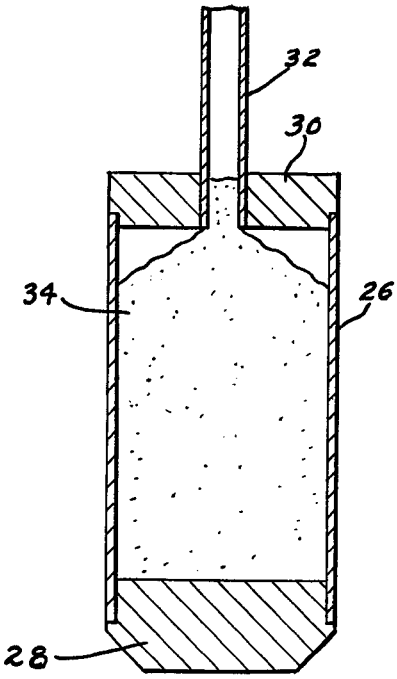
FIG. 2 shows a conventional powdered metal billet.

The conventional billet 12 has a construction as shown in FIG. 2. A cylindrical housing member 26 has a nose cap 28 at one end and tail cap 30 positioned at the opposite end. A fill tube 32 is provided in the tail cap 30. A powdered metal 34 is supplied to the housing member through fill tube 32.

The extrusion product provided after passing the billet 12 through the die 20 is shown in FIG. 3. The useable product from this prior art billet is indicated at A in FIG. 3. The product, in portions B, may have some limited use and the product, in portion C, is non-useable.

Figure 4:
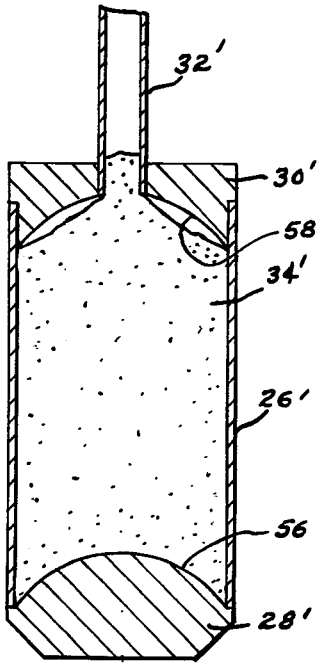
FIG. 4 shows the device of FIG. 2 modified according to one embodiment of the invention.
Figure 5:
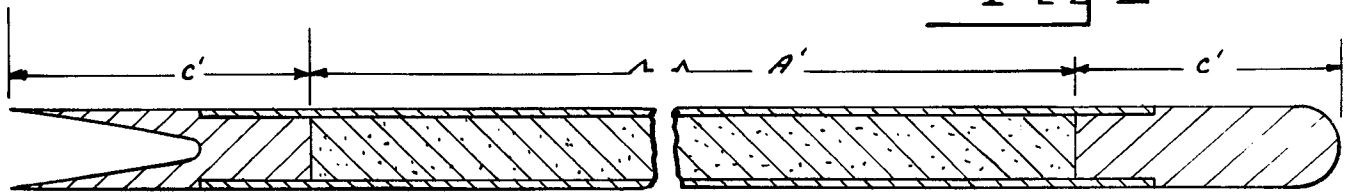
FIG. 5 is a schematic view of the billet of FIG. 4 after extrusion.

In order to increase the useable portion A of the extrusion product, the nose cap 28 and tail cap 30 are modified as shown at 28' and 30' in FIG. 4. This will provide an extrusion product as shown in FIG. 5, wherein the useable product, indicated at A', which is greater than the useable product indicated at A in FIG. 3.

The book "Metal Forming; Processes and Analysis" by Dr. Betzalel Avitzur, published by McGraw-Hill Book Co. 1968, pages 189–193 has an analyses of the deformation in a billet caused by flow through a conical converging die.

In the extrusion of a billet through a conical die, a straight line perpendicular to the axis of symmetry of the billet and passing through the axis distorts during deformation. Dr. Betzalel Avitzur in his book has determined the final distored shape of the straight line can be expressed by the following equation:

$$\frac{Z}{R_f} = \frac{1}{3\sin\alpha}\left[\frac{R_o^3}{R_f^3} - 1\right]\left[2 - 3\cos\theta + \frac{1}{\cos\theta}\right] \quad (1)$$

Figure 6:
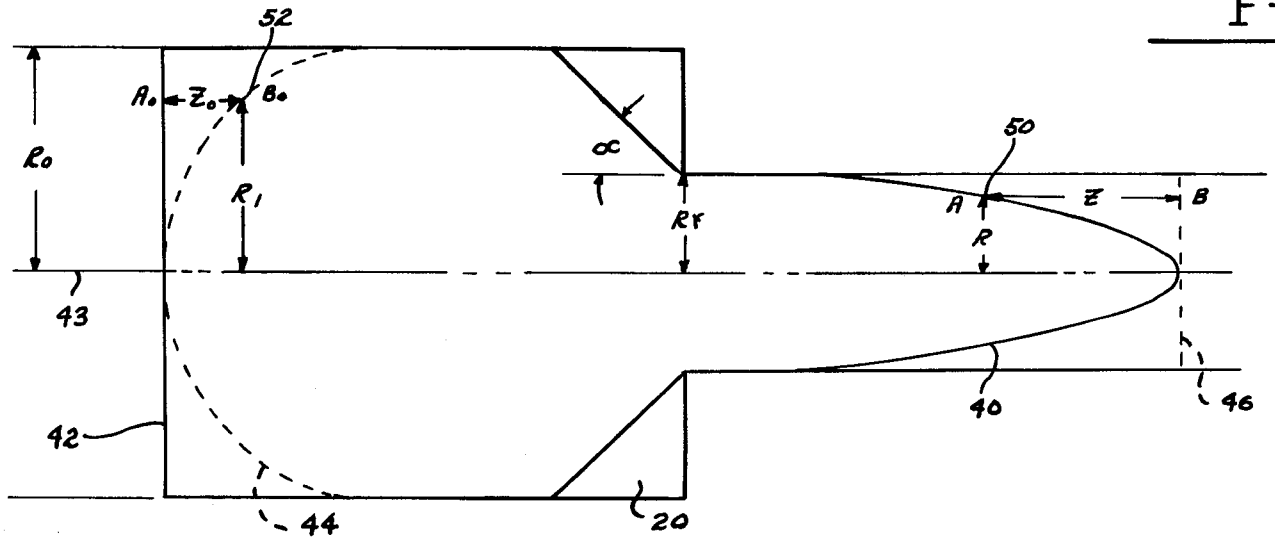
FIG. 6 is a schematic diagram used in the derivation of the relationship for describing the shape of the tail cap and head cap for the device of FIG. 4.
Figure 7:
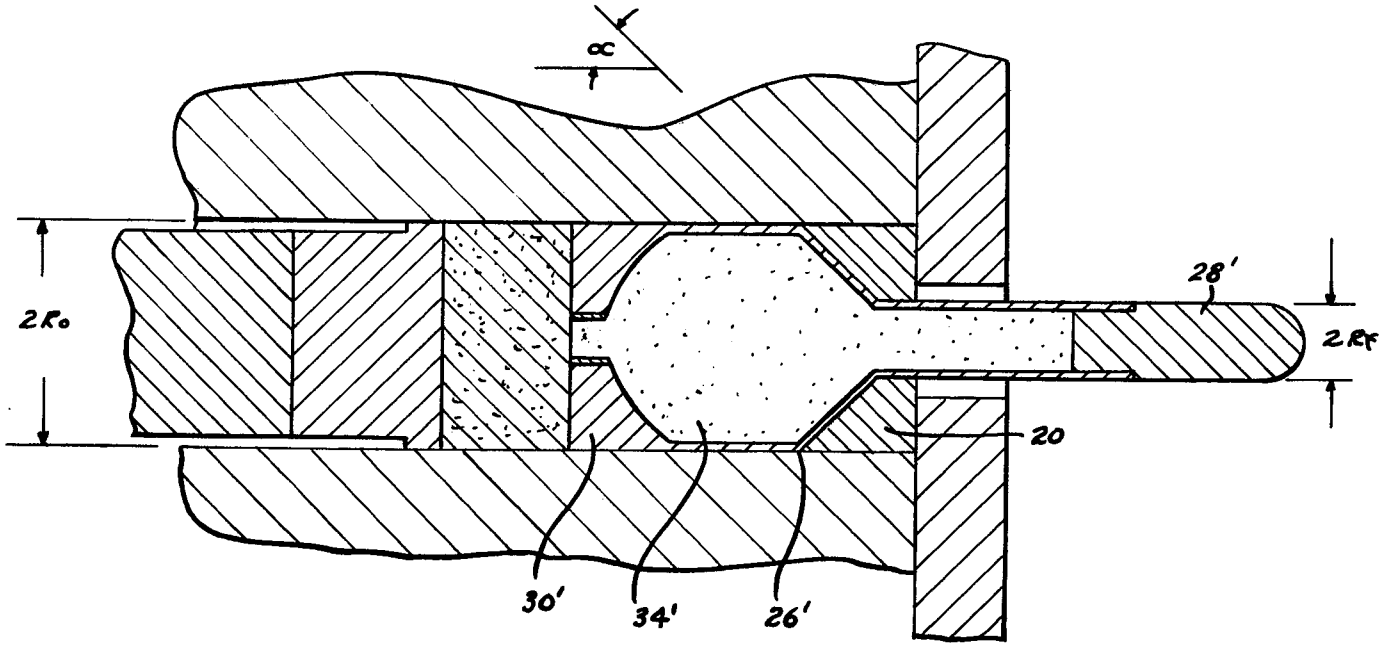

This equation is given as equation 8.42 on page 191. The shape is plotted in FIG. 8.20 of Azitur's book and is schematically illustrated as a quasi-parabolic curve 40 in FIG. 6. In this Figure the straight line mentioned above is indicated at 42 in FIG. 6.

To calculate the shape of the curved line 44 in the billet which would end as a straight line 46 after passing through a conical die 20 having a radius $R_f$ and an entrance half angle $\alpha$, certain relationships are substituted in the equation (1) given above.

From the explanation given on pages 188 and 189 of "Metals Forming: Processes and Analysis" it can be seen that point 50 on curve 40 at a distance R from the axis will appear at a distance $R_1$ from the axis in the original billet. From expression (a) on page 189:

$$\frac{R}{R_F} = \frac{R_1}{R_o} \quad (2)$$

therefore $$\frac{R_1}{R} = \frac{R_o}{R_F} \quad (3)$$

Point 50 is a distance Z from the line 46. The distance Zo that a point 52 at radius $R_1$ must be from line 42 to correspond to the distance Z between point 50 and line 46 may be determined from the fact that the volume of material bounded by a cylinder of length Zo at radius $R_1$ must be equal to the volume of material in a cylinder of length Z at radius R. Therefore:

$$\pi R^2 Z = \pi R_1^2 Z_o \quad (4)$$

$$Z = \frac{R_1^2}{R^2} Z_o = \left(\frac{R_1}{R}\right)^2 Z_o \quad (5)$$

by squaring (3) above and substituting in (5)

$$Z = \left(\frac{R_o}{R_F}\right)^2 Z_o \quad (6)$$

from (8.43*b*) in reference $$\text{Sin}\ \theta = \frac{R}{R_F} \sin \alpha \quad (7)$$

Therefore, $$\cos\theta = \left(1 - \frac{R_1 2}{R_o 2} \sin^2\alpha\right)^{\frac{1}{2}} \quad (8)$$

substituting (6) and (8) above in equation 1 yields the following relationship:

$$\frac{Z_o R_o^2}{R_f 3} = \frac{1}{3\sin\alpha}\left[\frac{R_o 3}{R_F^3} - 1\right]\left[2 - 3\left(1 - \frac{R_1 2}{R_o 2}\sin^2\alpha\right)^{\frac{1}{2}} + \left(1 - \frac{R_1^2}{R_o 2}\sin^2\alpha\right)^{-\frac{1}{2}}\right] \quad (9)$$

Multiplying both sides of the above equations by $R_f^3/R_o^3$ yields $$\frac{Z_o}{R_o} = \frac{1}{3\sin\alpha}\left[1 - \frac{R_f^3}{R_o^3}\right]\left[2 - 3\left(1 - \frac{R_1^2}{R_o^2}\sin^2\alpha\right)^{\frac{1}{2}} + \left(1 - \frac{R_1^2}{R_o^2}\sin^2\alpha\right)^{-\frac{1}{2}}\right] \quad (10)$$

or $$Z_o = \frac{R_o}{3\sin\alpha}\left[1 - \frac{R_f^3}{R_o^3}\right]\left[2 - 3\left(1 - \frac{R_1^2}{R_o^2}\sin^2\alpha\right)^{\frac{1}{2}} + \left(1 - \frac{R_1^2}{R_o^2}\sin^2\alpha\right)^{-\frac{1}{2}}\right] \quad (11)$$

Figure 7:
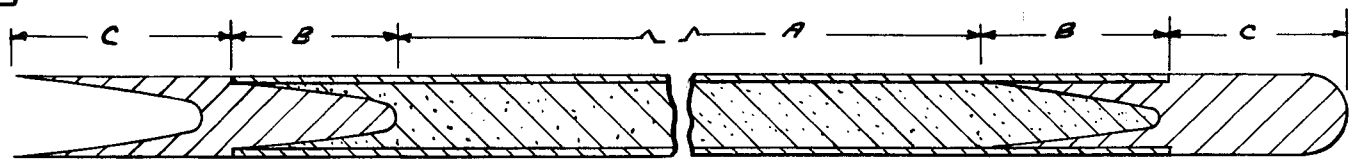
FIG. 7 is a schematic illustration of a partially extruded optimized billet of FIG. 4.

This optimized capsule of FIG. 4 during extrusion is shown schematically in FIG. 7 wherein the nose cap 28' is shown after extrusion and the tail cap 30' is shown before extrusion.

While the optimized capsule of FIG. 4 will provide the greatest length of useable product, the machining of surfaces 56 and 58 is costly and time consuming.

Figure 9:
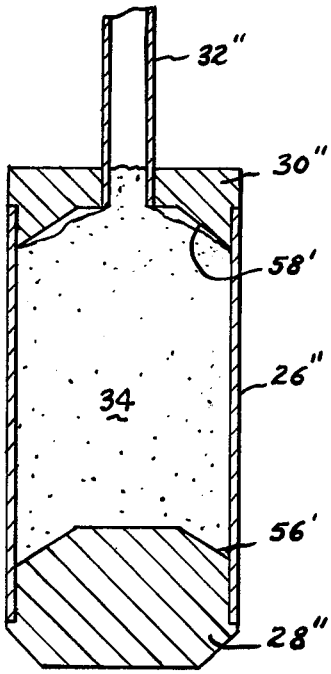
FIG. 9 shows a billet according to the invention with the head cap and tail cap made according to the approximation of FIG. 8.
Figure 8:
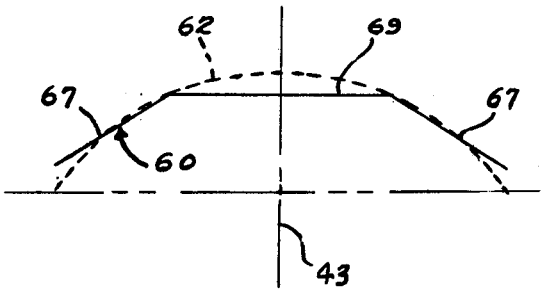
FIG. 8 shows one approximation which may be used with the device of FIG. 4 to simplify machining of the billet nose cap and tail cap.

The machining operation can be simplified in the manner shown in FIG. 8. The surfaces 56' and 58', on nose cap 28'' and tail cap 30'' respectively, in the device of FIG. 9 can have a shape corresponding to curve 60 in FIG. 8 which is made to approximately correspond to curve 62 as described in relationship (11). As can be seen in FIG. 8, the curve 60 has a conical surface 67 and a plane surface 69 perpendicular to the billet axis 43. Other straight line approximations which more closely follow the curve 60 could also be used.

Figure 10:
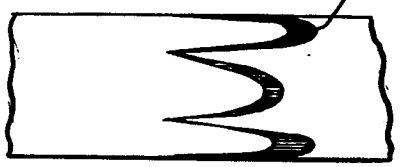
FIG. 10 shows a section of a drawn billet showing the shape of the approximate curve of FIG. 8 after drawing.

As shown in FIG. 10 the approximate curve 60, of FIG. 8, results in a very small loss of useable billet products. Lines corresponding to curve 60 were machined into one half of a part solid billet. The billet was then extruded and line 60' in FIG. 10 shows the approximate shape of the line 60 after extrusion.

In the construction of the billet the head cap and tail cap are welded into the tube 26' or 26'' and the fill tube 32' or 32'' are welded into tail cap 30' or 30''. After filling of the billet a vacuum source is connected to the fill tube 32' or 32'' and the billet is heated to 700° F. At the end of the evacuation process, the fill tube is crimped and then bent over and welded to seal the billet. The bent over end of the fill tube will be embedded in the graphite follower block 16 during the extrusion process.

There is thus provided a method and apparatus for increasing the yield of useable product in the extrusion of powder filled containers.

We claim:

1. An extrusion billet, for extrusion metal powder products, for passing through a die having a radius $R_f$ and an entrance taper having a half angle $\alpha$ comprising: a metal container having a cylindrical element, a nose cap at one end of the cylindrical element and a tail cap at the other end of the cylindrical element; said nose cap having a projection extending into said container; said projection having a contour substantially conforming to the relationship $$Z_o = \frac{R_o}{3\sin\alpha}\left[1 - \frac{R_f 3}{R_o 3}\right]\left[2 - 3\left(1 - \frac{R_1 2}{R_o 2}\sin^2\alpha\right)^{\frac{1}{2}} + \left(1 - \frac{R_1 2}{R_o 2}\sin^2\alpha\right)^{-\frac{1}{2}}\right]$$

where $Z_o$ is the distance of the contour surface from a plane passing through the apex of the contour surface; Ro is the outside radius of the billet; and $R_1$ is the radius measured from the longitudinal axis of the billet to the contour surface corresponding to $Z_o$; said tail cap having a concave contour substantially the same as the contour of the projection on the nose cap; a powder filling tube, having a portion passing through said tail cap; a finely divided metal powder within the metal container.

2. The device as recited in claim 1 wherein said nose cap projection and the tail cap concave contour each consist of at least one cylindrical surface at least one conical surface and one plane surface perpendicular to the billet axis with the surfaces of the nose cap and tail cap approximately conforming to the relationship $$Z_o = \frac{R_o}{3\sin\alpha}\left[1 - \frac{R_f^3}{R_o^3}\right]\left[2 - 3\left(1 - \frac{R_1^2}{R_o^2}\sin^2\alpha\right)^{\frac{1}{2}} + \left(1 - \frac{R_1^2}{R_o^2}\sin^2\alpha\right)^{-\frac{1}{2}}\right].$$

3. The method for making metal powder filled billets for extrusion through a die having a radius $R_f$ and an entrance taper with a half angle $\alpha$, comprising: machining a nose cap, adapted to fit into one end of a cylindrical housing, with a convex projection approximately conforming to the relationship $$Z_o = \frac{R_o}{3 \sin\alpha}\left[1 - \frac{R_o^3}{R_o^3}\right]\left[2 - 3\left(1 - \frac{R_1^2}{R_o^2}\sin^2\alpha\right)^{\frac{1}{2}} + \left(1 - \frac{R_1^2}{R_o^2}\sin^2\alpha\right)^{-\frac{1}{2}}\right]$$

where $Z_o$ is the distance of the contour surface from a plane passing through the apex of the contour surface; Ro is the outside radius of the billet; and $R_1$ is the radius measured from the longitudinal axis of the billet to the contour surface corresponding to $Z_o$; machining a tail cap, adapted to fit the other end of a cylindrical housing, with a concave surface approximately conforming to the relationship $$Z_o = \frac{R_o}{3 \sin\alpha}\left[1 - \frac{R_o^3}{R_o^3}\right]\left[2 - 3\left(1 - \frac{R_1^2}{R_o^2}\sin^2\alpha\right)^{\frac{1}{2}} + \left(1 - \frac{R_1^2}{R_o^2}\sin^2\alpha\right)^{-\frac{1}{2}}\right]$$

drilling a hole in the tail cap; securing a filler tube in said hole; securing the nose cap and the tail cap in opposite ends of a cylinder with the concave projection and the concave surface directed inwardly of the cylindrical housing; filling the cylindrical housing with a fine metal powder.

* * * * *